US006687951B2

(12) United States Patent
Illingworth et al.

(10) Patent No.: US 6,687,951 B2
(45) Date of Patent: Feb. 10, 2004

(54) TOROIDAL VORTEX BAGLESS VACUUM CLEANER

(75) Inventors: Lewis Illingworth, Kensington, NH (US); David Reinfeld, Englewood, NJ (US)

(73) Assignee: Vortex Holding Company, Avenel, NJ (US)

( * ) Notice: Subject to any disclaimer, the term of this patent is extended or adjusted under 35 U.S.C. 154(b) by 76 days.

(21) Appl. No.: 09/835,084

(22) Filed: Apr. 13, 2001

(65) Prior Publication Data

US 2002/0020035 A1 Feb. 21, 2002

Related U.S. Application Data

(63) Continuation-in-part of application No. 09/829,416, filed on Apr. 9, 2001, which is a continuation-in-part of application No. 09/728,602, filed on Dec. 1, 2000, which is a continuation-in-part of application No. 09/316,318, filed on May 21, 1999.

(51) Int. Cl.[7] ..... A47L 9/02
(52) U.S. Cl. ..... 15/346; 15/327.3
(58) Field of Search ..... 15/346, 327.3

(56) References Cited

U.S. PATENT DOCUMENTS 3,238,557 A * 3/1966 Foster ..... 15/339
4,204,298 A * 5/1980 Handa et al. ..... 15/344
4,570,287 A * 2/1986 Kerschner et al. ..... 15/340.1
4,571,849 A * 2/1986 Gardner et al. ..... 15/327.3
5,553,347 A * 9/1996 Inoue et al. ..... 15/327.3

FOREIGN PATENT DOCUMENTS

DE 661573 * 6/1938 ..... 15/346
FR 1475000 * 2/1967 ..... 15/346
SU 1020123 * 5/1983 ..... 15/327.3

* cited by examiner

*Primary Examiner*—Theresa T. Snider
(74) *Attorney, Agent, or Firm*—Ward & Olivo

(57) ABSTRACT

Disclosed are improved vacuum cleaning apparatus that utilize toroidal vortex air flow in order to establish a pressure differential capable of attracting debris. These systems differ significantly from prior vacuum cleaners in that they are essentially closed systems; there is no constant intake and exhaust of fluid. Disclosed herein are toroidal vortex vacuum cleaner nozzles that function with a fluid delivery system, which, in combination, yield a toroidal vortex that is split between the extreme ends of the nozzle. Also disclosed is a complete toroidal vortex vacuum system employing a centrifugal dirt separator. The present invention excels in being more efficient, lighter weight and quieter than the prior art.

13 Claims, 8 Drawing Sheets

TOROIDAL VORTEX BAGLESS VACUUM CLEANER

CROSS REFERENCE TO OTHER APPLICATIONS

This application is filed as a continuation-in-part of application Ser. No. 09/829,416 entitled "Toroidal and Compound Vortex Attractor", filed Apr. 9, 2001, which is a continuation-in-part of application Ser. No. 09/728,602, filed Dec. 1, 2000, entitled "Lifting Platform", which is a continuation-in-part of co-pending application Ser. No. 09/316,318, filed May 21, 1999, entitled "Vortex Attractor."

TECHNICAL FIELD OF THE INVENTION

The present invention relates initially, and thus generally, to an improved vacuum cleaner. More specifically, the present invention relates to an improved vacuum cleaner that utilizes a toroidal vortex such that the air pressure within the device housing is below atmospheric. In the present invention, this prevents dust-laden air within the device from being carried to the surrounding atmosphere.

BACKGROUND OF THE INVENTION

The use of vortex forces is known in various arts, including the separation of matter from liquid and gas effluent flow streams, the removal of contaminated air from a region and the propulsion of objects. However, a toroidal vortex has not previously been provided in a bagless vacuum device having light weight and high efficiency.

The prior art is strikingly devoid of references dealing with toroidal vortices in a vacuum cleaner application. However, an Australian reference has some similarities. Though it does not approach the scope of the present invention, it is worth disusing its key features of operation such that one skilled in the art can readily see how its shortcomings are overcome by the present invention disclosed herein.

In discussing Day International Publication number WO 00/19881 (the Day publication), an explanation of the Coanda effect is required. This is the ability for a jet of air to follow around a curved surface. It is generally referred to without explaining the effect, but is simply understood provided that one makes use of "momentum" theory; a system based on Newton's laws of motion, rather than try to weave an understanding from Bernoulli.

FIG. 1 shows the establishment of the Coanda effect. In (A) air is blown out horizontally from a nozzle 100 with constant speed V. The nozzle 100 is placed adjacent to a curved surface 102. Where the air jet 101 touches the curved surface 102 at point 103, the air between the jet 101 and the surface 102 as it curves away is pulled into the moving airstream both by air friction and the reduced air pressure in the jet stream, which can be derived using Bernoulli. As the air is carried away, the pressure at point 103 drops. There is now a pressure difference across the jet stream so the stream is forced to bend down, as in (B). The contact point 104 has moved to the right. As air is continuously being pulled away at point 104, the jet continues to be pulled down to the curved surface 102. The process continues as in (C) until the air jet velocity V is reduced by air and surface friction.

FIG. 2 shows the steady state Coanda effect dynamics. Air is ejected horizontally from a nozzle 200 with speed represented by vector 201 tangentially to a curved surface 203. The air follows the surface 203 with a mean radius 204. Air, having mass, tries to move in a straight line in conformance with the law of conservation of momentum. However, it is deflected around by a pressure difference across the flow 202. The pressure on the outside is atmospheric, and that on the inside of the airstream at the curved surface is atmospheric minus $\rho V^2/R$ where $\rho$ is the density of the air.

The vacuum cleaner coanda application of the Day publication has an annular jet 300 with a spherical surface 301, as shown in FIG. 3. The air may be ejected sideways radially, or may have a spin to it as shown with both radial and tangential components of velocity. Such an arrangement has many applications and is the basis for various "flying saucer" designs.

The simplest coanda nozzle 402 described in the Day publication is shown in FIG. 4. Generally, the nozzle 402 comprises a forward housing 407, rear housing 408 and central divider 403. Air is delivered by a fan to an air delivery duct 400 and led 401 to an output nozzle 402. At this point the airflow cross section is reduced so that air flowing through the nozzle 402 does so at high speed. The air may also have a rotational component, as there is no provision for straightening the airflow after it leaves the air pumping fan. The central divider 403 swells out in the terminating region of the output nozzle 402 and has a smoothly curved surface 404 for the air to flow around into the air return duct using the coanda effect.

Air in the space below the coanda surface moves at high speed and is at a lower than ambient pressure. Thus dust in the region is swept up 405 into the airflow 409 and carried into the air return duct 406. For dust to be carried up from the surface, the pressure is preferably low and carrying the air up the return duct 406, requires a steady airflow. After passing through a dust collection system the air is connected through a fan back to the air delivery duct. Constriction of the airflow by the output nozzle leads to a pressure above ambient in this duct ahead of the jet. In sum, air pressure within the system is above ambient in the air delivery duct and below ambient in the air return duct. The overall system is not shown, as this is not necessary to understand its fundamental characteristics.

Coanda attraction to a curved surface is not perfect, and as shown in FIG. 5, not all the air issuing from the output nozzle is turned around to enter the air return duct. An outer layer of air proceeds in a straight fashion 501. When the nozzle is close to the floor, this stray air will be deflected to move horizontally parallel to the floor and should be picked up by the air return duct if the pressure there is sufficiently low. In this case, the system may be considered sealed; no air enters or leaves, and all the air leaving the output nozzle is returned.

When the nozzle is high above the ground, however, there is nothing to turn stray air 501 around into the air return duct and it proceeds out of the nozzle area. Outside air 502, with a low energy level is sucked into the air return to make up the loss. The system is no longer sealed. An example of what happens then is that dust underneath and ahead of the nozzle is blown away. In a bagless system such as this, where fine dust is not completely spun out of the airflow but recirculates around the coanda nozzle, some of this dust will be returned to the surrounding air.

Air leakage is exacerbated by rotation in the air delivery duct caused by the pumping fan. Air leaving the output nozzle rotates so that centrifugal force spreads out the airflow into a cone. The results in the generation of a larger amount of stray air. Air rotation can be eliminated by adding flow straightening vanes to the air delivery duct, but these are neither mentioned nor illustrated in the Day publication.

A side and bottom view of an annular coanda nozzle 600 is shown in FIG. 6. This is a symmetrical version of the nozzle shown in FIG. 4. Generally, the nozzle 600 comprises outer housing 602, air delivery duct 601, air return duct 605, flow spreader 603 and annular coanda nozzle 604. Air passes down though the central air delivery duct 601, and is guided out sideways by a flow spreader 603 to flow over an annular curved surface 604 by the coanda effect, and is collected through the air return duct 605 by a tubular outer housing 602.

This arrangement exhibits similar behavior as previously described. Air strays away from the coanda flow, particularly when the jet is spaced away from a surface.

While it is conceivable that the performance of the invention of the Day publication would be improved by blowing air in the reverse direction, down the outer air return duct and back up through the central air delivery duct, stray air would then accumulate in the central area rather than be ejected out radially. Unfortunately, the spinning air from the air pump fan would cause the air from the nozzle to be thrown out radially due to centrifugal force (centripetal acceleration) and the system would not work. This effect could be overcome by the addition of flow straightening vanes following the fan. However, the Day publication does not disclose a means for staightening airflow.

The Day publication has more complex systems with jets to accelerate airflow to pull it around the coanda surface, and additional jets to blow air down to stir up dust and others to optimize airflow within the system. However, these additions are not pertinent to the analysis herein.

The new toroidal vortex vacuum cleaner is a bagless design and one in which airflow must be contained within itself at all times. Air continually circulates from the area being cleaned, through the dust collector and back again. Dust collection is not perfect and so air returning to the surface is dust laden. This air must, of course, contact the surface in order to pick up more dust but must not be allowed to escape into the surrounding atmosphere. It is not sufficient to design the cleaner to ensure essentially sealed operation while operating adjacent to a surface being cleaned, it must also remain sealed when away from a surface to prevent fine dust particles from re-entering the surrounding air.

Another reason for maintaining sealed operation when away from the surface is to prevent the vacuum cleaner nozzle from blowing surface dust around when it is held at a distance from the surface.

The Day publication, in most of its configurations, is coaxial in that air is blown out from a central duct and is returned into a coaxial return duct. The toroidal vortex attractor is coaxial and operates the reverse way in that air is blown out of an annular duct and returned into a central duct. The one is the reverse of the other.

The inventor has also noted the presence of cyclone bagless vacuum cleaners in the prior art. The present invention utilizes an entirely different type of flow geometry allowing for much greater efficiency and lighter weight. Nonetheless, the following represent references that the inventor believes to be representative of the art in the field of bagless cyclone vacuum cleaners. One skilled in the art will plainly see that these do not approach the scope of the present invention.

Dyson U.S. Patent No. 4,593,429 discloses a vacuum cleaning appliance utilizing series connected cyclones. The appliance utilizes a high-efficiency cyclone in series with a low-efficiency cyclone. This is done in order to effectively collect both large and small particles. In conventional cyclone vacuum cleaners, large particles are carried by a high-efficiency cyclone, thereby reducing efficiency and increasing noise. Therefore, Dyson teaches incorporating a low-efficiency cyclone to handle the large particles. Small particles continue to be handled by the high-efficiency cyclone. While Dyson does utilize a bagless configuration, the type of flow geometry is entirely different. Furthermore, the energy required to sustain this flow is much greater than that of the present invention.

Song, et al U.S. Pat. No. 6,195,835 is directed to a vacuum cleaner having a cyclone dust collecting device for separating and collecting dust and dirt of a comparatively large particle size. The dust and dirt is sucked into the cleaner by centrifugal force. The cyclone dust collecting device is biaxially placed against the extension pipe of the cleaner and includes a cyclone body having two tubes connected to the extension pipe and a dirt collecting tub connected to the cyclone body. Specifically, the dirt collecting tub is removable. The cyclone body has an air inlet and an air outlet. The dirt-containing air sucked via the suction opening enters via the air inlet in a slanting direction against the cyclone body, thereby producing a whirlpool air current inside of the cyclone body. The dirt contained in the air is separated from the air by centrifugal force and is collected at the dirt collecting tub. A dirt separating grill having a plurality of holes is formed at the air outlet of the cyclone body to prevent the dust from flowing backward via the air outlet together with the air. Thus, the dirt sucked in by the device is primarily collected by the cyclone dust connecting device, thus extending the period of time before replacing the paper filter. The device of Song et al differs primarily from the present invention in that it requires a filter. The present invention utilizes such an efficient flow geometry that the need for a filter is eliminated. Furthermore, the conventional cyclone flow of Song et al is traditionally less energy efficient and noisier than the present invention.

Thus, there is a clear and long felt need in the art for a light weight, efficient and quiet bagless vacuum cleaner.

SUMMARY OF THE INVENTION

The present invention was developed from the applicant's prior inventions regarding toroidal vortex attractors.

Described herein are embodiments that deal with both toroidal vortex vacuum cleaner nozzles and systems. The nozzles include simple concentric systems and more advanced, optimized systems. Such optimized systems utilize a thickened inner tube that is rounded off at the bottom for smooth airflow from the air delivery duct to the air return duct. It is also contemplated that the nozzle include flow straightening vanes to eliminate rotational components in the airflow that would greatly harm efficiency. The cross section of the nozzle need not be circular, in fact, a rectangular embodiment is disclosed therein, and other embodiments are possible.

A complete toroidal vortex bagless vacuum cleaner is also disclosed. The air mover is a centrifugal pump, much like those used in certain toroidal vortex attractor embodiments. Air leaving the centrifugal pump blades is spinning rapidly so that dust and dirt are thrown to the sidewalls of the casing. Ultimately, dirt is deposited in a centrifugal dirt separation area. The air then turns upwards over a dirt barrier and down the air delivery duct. At this point, the air is quite clean except for the finest particulates that do not deposit in the centrifugal dirt separation area. These particulates circulate through the system repeatedly until they are eventually deposited. The system operates below atmospheric pressure so that air laden with fine dust is constrained within the system, and cannot escape into the surrounding atmosphere.

Unlike other vacuum cleaners that employ centrifugal dust separation (e.g., the "cyclone" types discussed above), the present invention spins the air around at the blade speed of the centrifugal pump. Thus, the system acts like a high speed centrifuge capable of removing very small particles from the airflow. Therefore, no vacuum bag or HEPA filter is required.

One of the main features of the present invention is the inherent low power consumption. There are no losses that must exist when bags or HEPA filters are utilized. These devices restrict the airflow, thus requiring greater power to maintain a proper flow rate. The majority of the power saving, however, comes from the closed air system in which energy supplied by the pump is not lost as air is expelled into the atmosphere, but is retained in the system. The design is expected to be practically maintenance free.

Thus, it is an object of the present invention to utilize toroidal vortices in a vacuum cleaner application.

It is a further object of the present invention to provide toroidal vortex vacuum cleaner nozzles.

It is yet another object of the present invention to provide a complete toroidal vortex vacuum cleaner system.

Additionally, it is an object of the present invention to provide an efficient vacuum cleaner.

Furthermore, it is an object of the present invention to provide a quiet vacuum cleaner.

It is a further object of the present invention to provide a light weight vacuum cleaner.

In addition, it is an object of the present invention to provide a low-maintenance vacuum cleaner.

It is yet another object of the present invention to provide a bagless vacuum cleaner.

It is a further object of the present invention to provide a vacuum cleaner that does not require the use of filters.

SUMMARY OF THE DRAWINGS

A further understanding of the present invention can be obtained by reference to a preferred embodiment set forth in the illustrations of the accompanying drawings. Although the illustrated embodiment is merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawings in which.

DETAILED DESCRIPTION OF THE PREFERRED EMBODIMENTS

As required, a detailed illustrative embodiment of the present invention is disclosed herein. However, techniques, systems and operating structures in accordance with the present invention may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present invention. The following presents a detailed description of a preferred embodiment (as well as some alternative embodiments) of the present invention.

Certain terminology will be used in the following description for convenience in reference only and will not be limiting. The words "in" and "out" will refer to directions toward and away from, respectively, the geometric center of the device and designated and/or reference parts thereof. The words "up" and "down" will indicate directions relative to the horizontal and as depicted in the various figures. The words "clockwise" and "counterclockwise" will indicate rotation relative to a standard "right-handed" coordinate system. Such terminology will include the words above specifically mentioned, derivatives thereof and words of similar import.

Figure 1A:
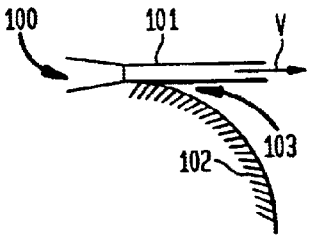
FIG. 1A (PRIOR ART)
FIG. 1, already discussed, depicts the establishment of the coanda effect (PRIOR ART)
Figure 1B:
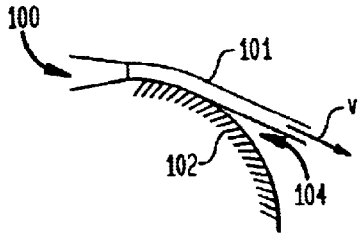
FIG. 1B (PRIOR ART)
Figure 1C:
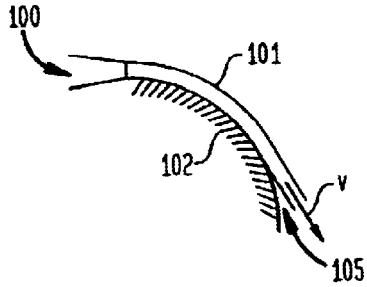
FIG. 1C (PRIOR ART)
Figure 2:
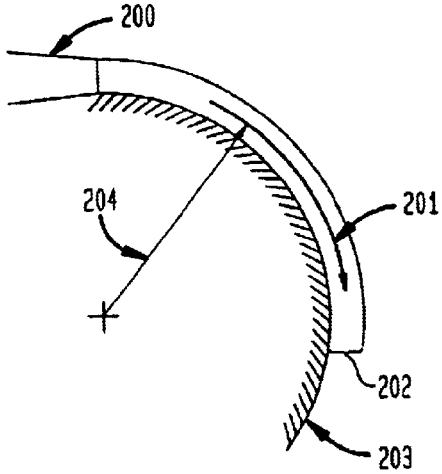
FIG. 2 (PRIOR ART)
FIG. 2, already discussed, depicts the dynamics of the coanda effect (PRIOR ART)
Figure 3:
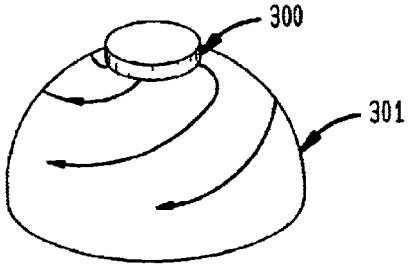
FIG. 3 (PRIOR ART)
FIG. 3, already discussed, depicts the coanda effect on a spherical surface with both radial and tangential components of motion (PRIOR ART)
Figure 4:
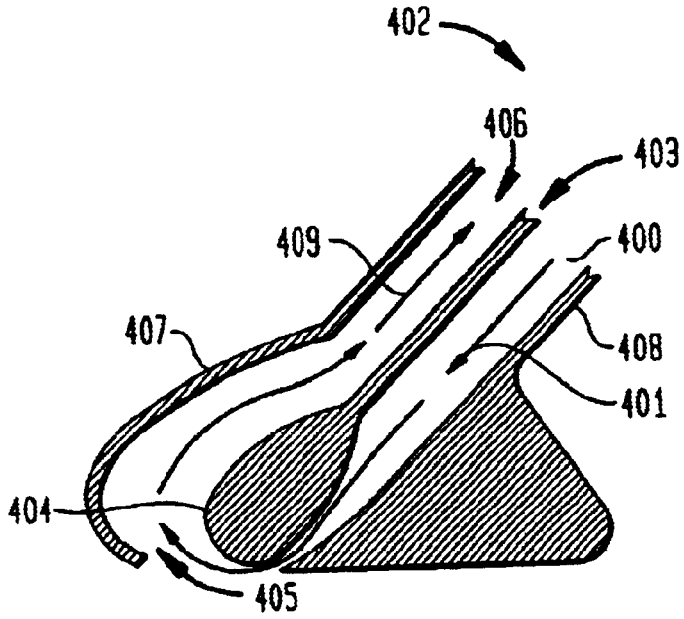
FIG. 4 (PRIOR ART)
FIG. 4, already discussed, depicts a coanda vacuum cleaner nozzle (PRIOR ART)
Figure 5:
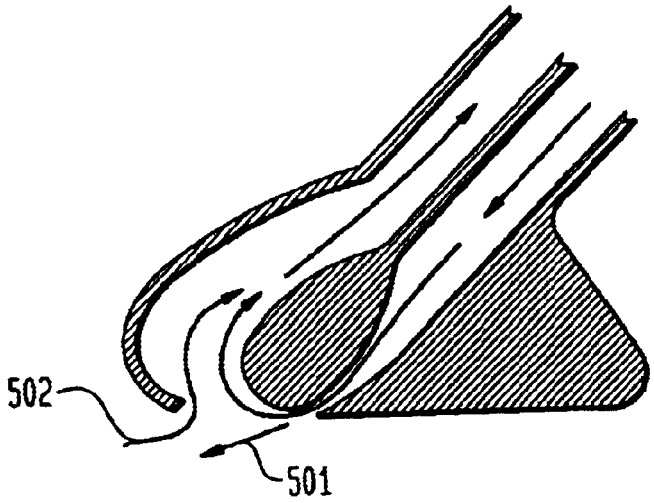
FIG. 5 (PRIOR ART)
FIG. 5, already discussed, depicts the undesirable airflow in a coanda vacuum cleaner nozzle (PRIOR ART)
Figure 6:
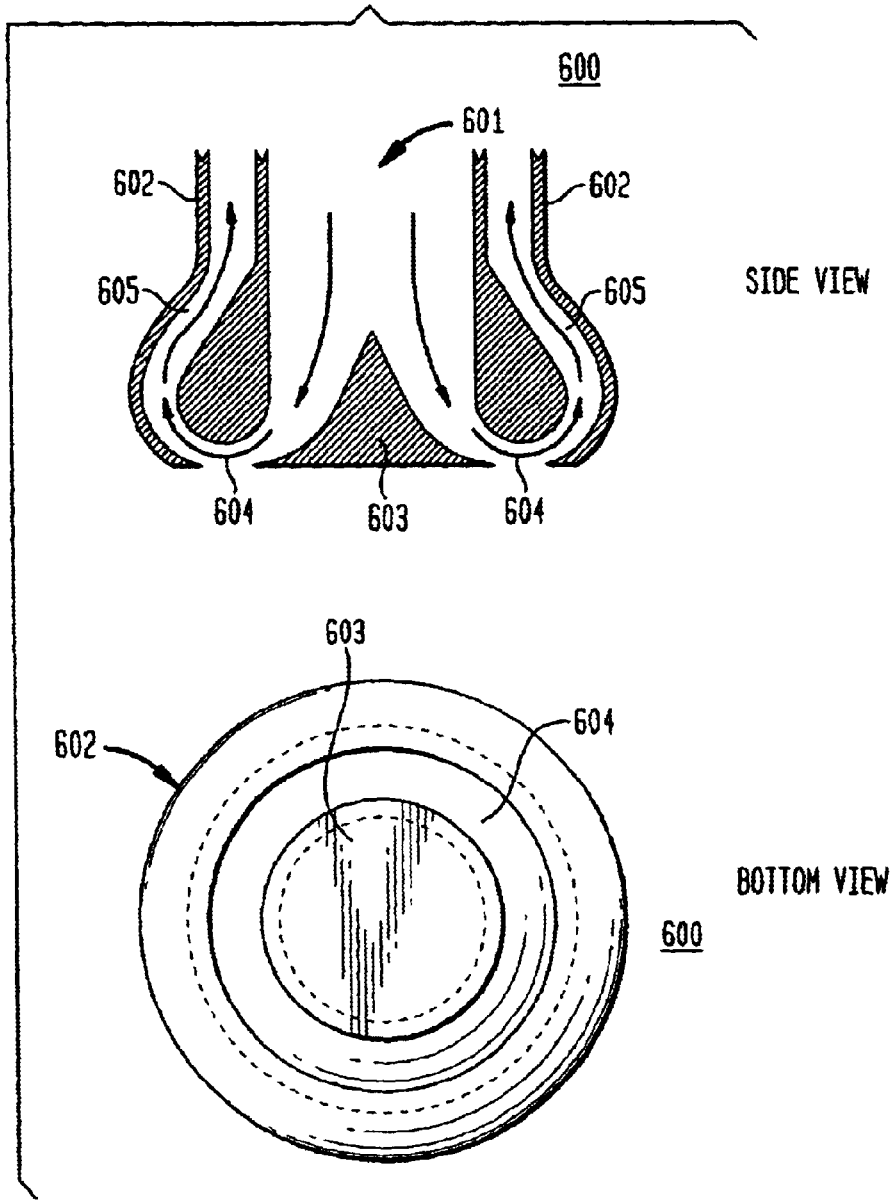
FIG. 6 (PRIOR ART)
FIG. 6, already discussed, depicts a side and bottom view of an annular coanda vacuum cleaner nozzle (PRIOR ART)
Figure 7:
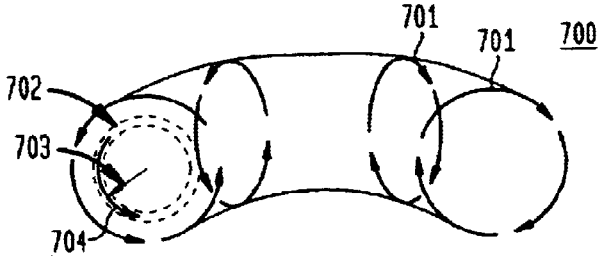
FIG. 7 depicts a toroidal vortex, shown sliced in half.

A toroidal vortex is a donut of rotating air. The most common example is a smoke ring. It is basically a self-sustaining natural phenomenon. FIG. 7 shows a toroidal vortex 700, at an angle, and sliced in two to illustrate the airflow 701. In a section of the vortex, a particular air motion section is shown by a stream tube 702, in which the air constantly circles around. Here it is shown with a mean radius 703 and mean speed 704. Circular motion is maintained by a pressure difference across the stream tube, the pressure being higher on the outside than the inside. This pressure difference $\Delta p$ is, by momentum theory, $\Delta p=\rho V^2/R$ where $\rho$ is the air density, R is radius 703 and V is velocity 704. Thus the pressure decreases from the outside of the toroid to the center of the cross section, and then increases again towards the center of the toroid. The example shows air moving downwards on the outside of the toroid 700, but the airflow direction can be reversed for the function and pressure profile to remain the same. The downward outside motion is chosen because it is the preferred direction used in the toroidal vortex vacuum cleaner of the present invention.

Figure 8:
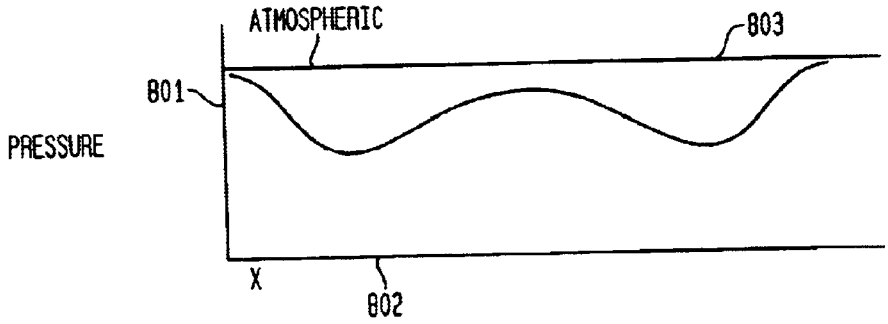
FIG. 8 graphically depicts the pressure distribution across the toroidal vortex of FIG. 7.

FIG. 8 shows a typical pressure profile across the toroidal vortex. Shown is the pressure on axis 801 as a function of distance in the x direction 802. Line 803 is a reference for atmospheric pressure, which remains constant along the x direction.

Figure 9:
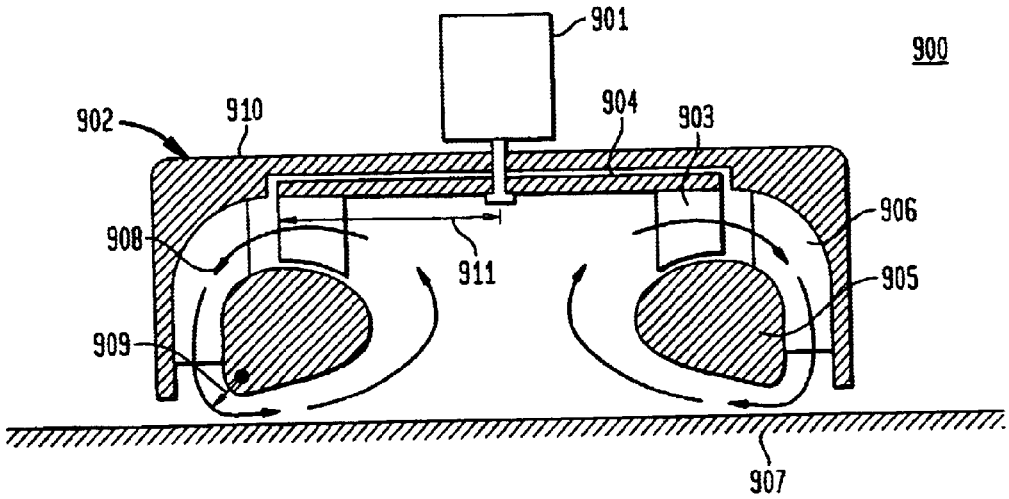
FIG. 9 depicts a toroidal vortex attractor.

The present invention was developed from a toroidal vortex attractor previously described by the inventor. FIG. 9 shows a toroidal vortex attractor that has a motor 901 driving a centrifugal pump located within an outer housing 902. The centrifugal pump comprises blades 903 and backplate 904. This pumps air around an inner shroud 905 so that the airflow is a toroidal vortex with a solid donut core. Flow straightening vanes 906 are inserted after the centrifugal pump and between the inner shroud 905 and the outer casing 902 in order to remove the tangential component of air motion from the airflow. The air moves tangentially around the inner shroud 905 cross section, but radially with respect to the centrifugal pump.

Air pressure within the housing 902 is below ambient. The pressure difference between ambient and inner air is maintained by the curved airflow around the inner shroud's 905 lower outer edge. The outer air turns the downward flow between the inner shroud 905 and outer casing 902 into a horizontal flow between the inner shroud and the attracted surface 907. This pressure difference is determined by $\rho v^2/r$ where v is the speed of the air circulating 908 around the inner shroud 905, r is the radius of curvature 909 of the airflow and ρ is the air density. The maximum air pressure differential is determined by the centrifugal pump blade tip speed (V) at point 910, and tip radius (R) 911 ($\rho V^2/R$).

The toroidal vortex attractor 900 can be thought of as a vacuum cleaner without a dust collection system. Dust particles picked up from the attracted surface 907 are picked up by the high speed low pressure airflow and circulate around.

The new toroidal vortex vacuum cleaner is a bagless design and one in which airflow must be contained within itself at all times. Air continually circulates from the area being cleaned, through the dust collector and back again. Dust collection is not perfect and so air returning to the surface is dust laden. This air must, of course, contact the surface in order to pick up more dust but must not be allowed to escape into the surrounding atmosphere. It is not sufficient to design the cleaner to ensure essentially sealed operation while operating adjacent to a surface being cleaned, it must also remain sealed when away from a surface to prevent fine dust particles from re-entering the surrounding air.

Another reason for maintaining sealed operation is to prevent the vacuum cleaner nozzle from blowing surface dust around when it is held at a distance from the surface.

Figure 10:
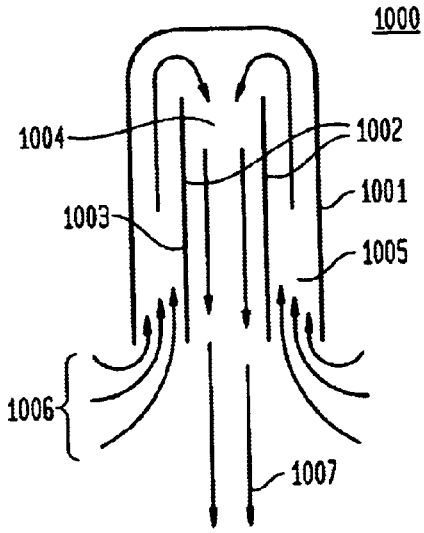
FIG. 10 depicts a cross section of a concentric vacuum system.

The toroidal vortex attractor is coaxial and operates in a way that air is blown out of an annular duct and returned into a central duct. FIG. 10 shows a system 1000 comprising outer tube 1001 and inner tube walls 1002 (which form inner tube 1003) in which air passes down the inner tube 1003 and returns up the outer tube 1001. While it would be desirable that the outgoing air returns up into the air return duct 1005, a simple experiment shows that this is not so. Air from the central delivery duct 1004 forms a plume 1007 that continues on for a considerable distance before it disperses. Thus, air is sucked into the air return duct from the surrounding area 1006. This arrangement, without coanda jet shaping is clearly unsuited to a sealed vacuum cleaner design.

Figure 11:
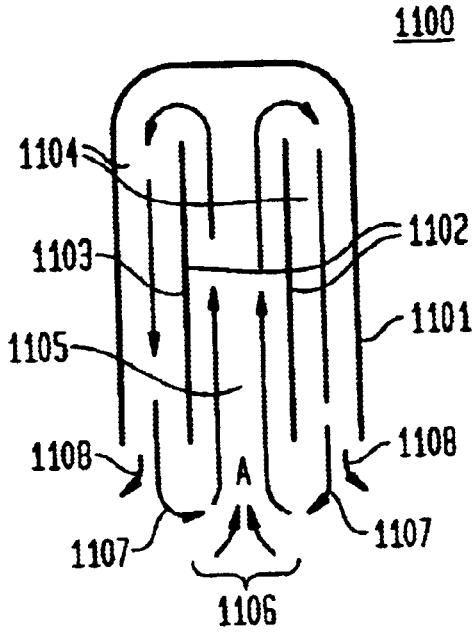
FIG. 11 depicts a concentric vacuum system with air being sucked up the center and blown down the sides.

FIG. 11 shows a system 1100 having the reverse airflow of FIG. 10. Again, system 1100 comprises outer tube 1101 and inner tube walls 1102 (which form inner tube 1103). Air is blown down the outer air delivery duct 1104 and returned up the central return duct 1105. Air is initially blown out in a tube conforming to the shape of the outer air delivery duct 1104. As this air originates in the inner tube 1103, replacement air must be pulled from the space inside the tube of outgoing air. This leads to a low pressure zone at A, within and below the air return duct 1105. Consequently air is pulled in at A from the outgoing air. Thus the air (whose flow is exemplified by arrows 1107) is forced to turn around on itself and enter the return duct 1105. Such action is not perfect and a certain amount of air escapes 1108 at the sides of the air delivery duct, and is replaced by the same small amount of air 1106 being drawn into the air return duct 1105.

Figure 12:
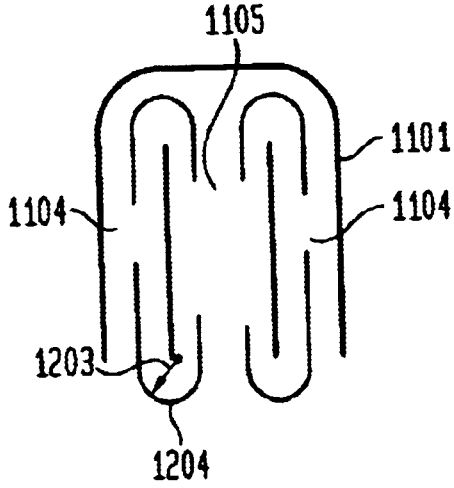
FIG. 12 depicts the dynamics of the re-entrant airflow of the system of FIG. 11.

Air interchange is reduced by the lowering of the air pressure within the concentric system. FIG. 12 shows air returning from the delivery duct 1104 into the return duct 1105 with radius of curvature (R) 1203 and the velocity at 1204. With airspeed V at 1204, the pressure difference between the ambient outer air and the inside is $\rho V^2/R$, where ρ is the air density. The airflow at the bottom of the concentric tubes is in fact half of a toroidal vortex, the other half being at the top of the inner tube within the outer casing 1101. The system of FIGS. 11 and 12 is thus a vortex system, with a low internal pressure and minimal mixing of outer and inner air.

Figure 13:
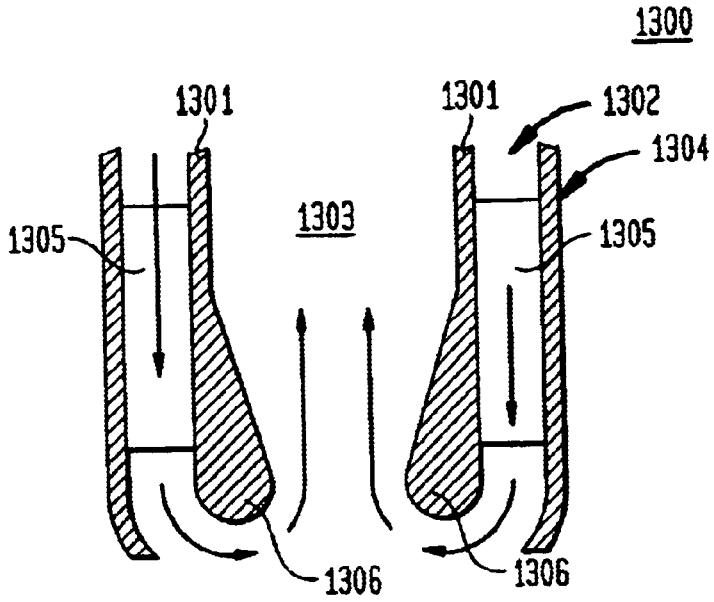
FIG. 13 depicts a cross section of an exemplary toroidal vortex vacuum cleaner nozzle in accordance with the present invention.

The simple concentric nozzle system shown in FIGS. 11 and 12 can be optimized into an effective toroidal vortex vacuum cleaner nozzle 1300 depicted in FIG. 13. The inner tube 1301 is thickened out and rounded off at the bottom (inner fairing 1306) for smooth airflow around from the air delivery duct 1302 to the air return duct 1303. The outer tube 1304 is extended a little way below the inner tube 1301 end and rounded inwards somewhat so that air from the delivery duct 1302 is not ejected directly downwards but tends towards the center. This minimizes the amount of air leaking sideways from the main flow. The nozzle has flow straightening vanes 1305 to eliminate any corkscrewing in the downward air motion in the air delivery duct 1302 that would throw air out sideways from the bottom of the outer tube 1304 due to centrifugal action. When compared to the coanda nozzles of the prior art, the vortex nozzle 1300 has less leakage and has a much wider opening for the high speed air flow to pick up dust.

Figure 14:
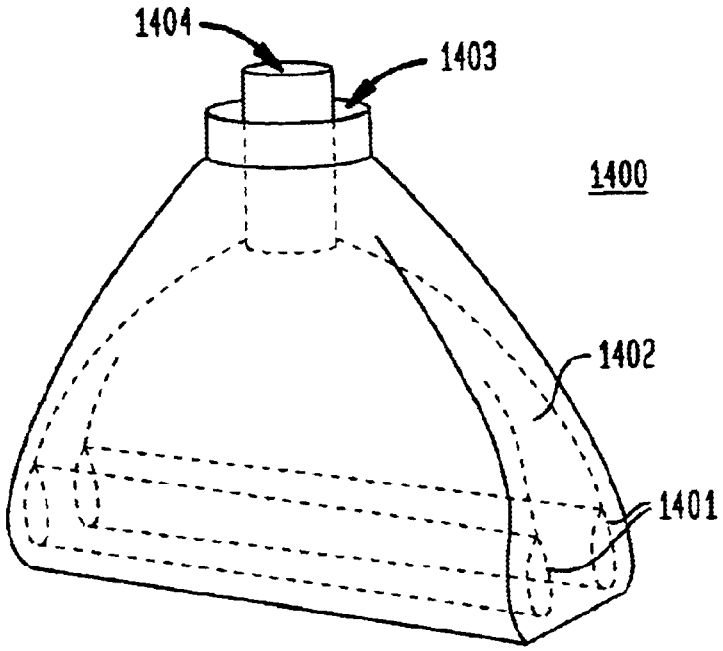
FIG. 14 depicts a perspective view of an exemplary rectangular toroidal vortex vacuum cleaner nozzle in accordance with the present invention.

The vortex nozzle has so far been depicted as circular in cross section, but this is not at all necessary. FIG. 14 shows a rectangular nozzle 1400 in which the ends are terminated by bringing the inner fairings 1401 to butt against the outer tube 1402. Air is delivered via the delivery duct 1403 and returns via the return duct 1404. Flow straightening vanes are omitted from FIG. 14 for clarity, but are, of course, essential. An alternate system, not shown, is to carry the nozzle cross section of FIG. 13 around the ends, as there will be some air leakage around the flat ends.

Figure 15:
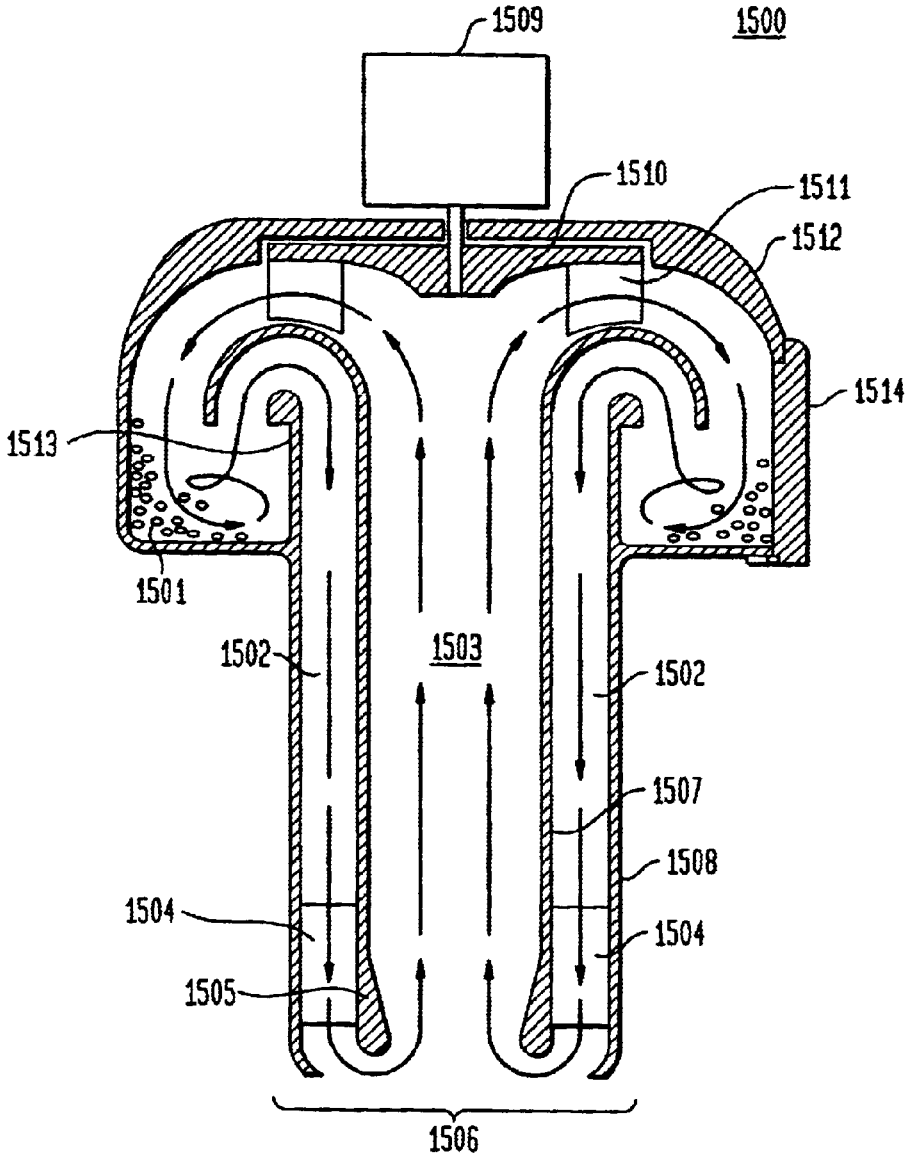
FIG. 15 depicts a cross section of an exemplary toroidal vortex bagless vacuum cleaner having an exemplary circular plan form.

FIG. 15 shows the addition of a centrifugal dirt separator, yielding a complete toroidal vortex vacuum cleaner 1500. Again, the ducting is created by an inner tube 1507 placed concentrically within outer tube 1508. Airflow through the outer air delivery duct 1502, the inner air return duct 1503 and the toroidal vortex nozzle 1506 (comprising flow straightening vanes 1504 and inner fairing 1505) are as described previously in FIGS. 12, 13 and 14. The air mover is a centrifugal air pump (as in the toroidal vortex attractor of FIG. 9) comprising motor 1509, backplate 1510 and blades 1511. Air leaving the centrifugal pump blades is spinning rapidly so that dust and dirt are thrown to the circular sidewall of the outer casing 1512. Air moves downward and inwards to follow the bottom of the dirt box 1501 so that dirt is precipitated there as well. The air then turns upwards over a dirt barrier 1513 and down the air delivery duct 1502. At this point, the air is clean except for fine particulates that fail to be deposited. These circulate through the system repeatedly until they are finally deposited out. The system operates below atmospheric pressure so that air laden with fine dust is constrained within the system and cannot escape into the surrounding atmosphere. After use, the dirt that has been collected in the dirt box 1501 can be emptied via the dirt removal door 1514.

FIG. 15 depicts a circular nozzle 1506, but the system works equally well with the rectangular nozzle of FIG. 14. Various nozzle shapes can be designed and will operate satisfactorily, providing that the basic cross section of FIG. 13 is used.

This embodiment has air mixed with dirt and dust passing through the centrifugal impeller vanes. If such an arrangement is considered undesirable, the addition of a trap for large debris may be inserted into the air return path upstream of the impeller.

While the present invention has been described with reference to one or more preferred embodiments, which embodiments have been set forth in considerable detail for the purposes of making a complete disclosure of the invention, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention.

I claim:

1. A toroidal Vortex vacuum nozzle comprising:

an outer tube;

an inner tube coaxially positioned inside said outer tube, wherein a gap between said inner tube and said outer tube forms an annular delivery duct;

fluid delivery means coupled to said annular delivery duct to provide a fluid flow therein; and guide means to guide said fluid flow out of said annular delivery duct and into said inner tube, said guide means comprising an inwardly rounded portion positioned at a distal end of said outer tube;

wherein said guide means guides said fluid flow such that said fluid flow has substantially the characteristics of a toroidal vortex, and further wherein said fluid does not escape substantially into the atmosphere outside of said outer tube.

2. The toroidal vortex vacuum nozzle according to claim 1, wherein said guide means further comprises flow straightening vanes.

3. The toroidal vortex vacuum nozzle according to claim 1, wherein a cross section of said nozzle comprises a circular shape.

4. The toroidal vortex vacuum nozzle according to claim 1, wherein a cross section of said nozzle comprises a rectangular shape.

5. The toroidal vortex vacuum nozzle according to claim 1, wherein said fluid delivery means comprises a centrifugal pump.

6. The toroidal vortex vacuum nozzle according to claim 1, wherein said fluid delivery means comprises a motor.

7. A bagless toroidal vortex vacuum system comprising:

fluid delivery means to provide a fluid flow through said system;

a centrifugal separation chamber fluidly coupled to said fluid delivery means;

a toroidal vortex nozzle comprising:

an outer tube coupled to said said centrifugal separation chamber at a proximal end, a distal end of said outer tube being open to the atmosphere;

an inner tube coaxially positioned inside said outer tube, wherein a gap between said inner tube and said outer tube forms an annular delivery duct which receives said fluid flow from said fluid delivery means; and guide means to guide said fluid flow out of said annular delivery duct and into said inner tube, said guide means comprising an inner fairing positioned at a distal end of said inner tube;

wherein said guide means guides said fluid flow such that said fluid flow has substantially the characteristics of a toroidal vortex, and further whereupon said fluid flow passes across said distal end of said outer tube, said fluid flow is capable of attracting dirt, debris, and other particulate matter that is ultimately deposited in said centrifugal separation chanter, and further wherein said fluid, flow does not escape substantially into said atmosphere.

8. The bagless toroidal vortex vacuum system according to claim 7, wherein said system further comprises a dirt removal door on said separation chamber.

9. The bagless toroidal vortex vacuum system according to claim 7, wherein said fluid delivery means comprises a centrifugal pump.

10. The bagless toroidal vortex vacuum system according to claim 7, wherein said fluid delivery means comprises a motor.

11. The bagless toroidal vortex vacuum system according to claim 7, wherein said guide means further comprises flow straightening vanes.

12. A method of providing a toroidal vortex vacuum system, comprising the steps of:

providing a toroidal vortex flow from a recirculating fluid flow, said toroidal vortex flow occurring at a toroidal vortex nozzle;

attracting matter into said toroidal vortex nozzle utilizing attractive forces of said vortex flow; and depositing said matter into a chamber along the path of said fluid flow;

wherein said toroidal vortex nozzle comprises an inwardly rounded member adjacent to where said matter is attracted into said toroidal vortex nozzle, wherein said inwardly rounded member guides said vortex flow such that said vortex flow is substantially recirculated into said toroidal vortex nozzle.

13. The method according to claim 12, wherein said method further comprises the step of removing said matter from said chamber.

* * * * *